US010208509B2

(12) United States Patent
Hammerer

(10) Patent No.: US 10,208,509 B2
(45) Date of Patent: Feb. 19, 2019

(54) PUSH-OUT DEVICE FOR A MOVABLE FURNITURE PART

(71) Applicant: Julius Blum GmbH, Hoechst (AT)

(72) Inventor: Andre Hammerer, Alberschwende (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 15/834,669

(22) Filed: Dec. 7, 2017

(65) Prior Publication Data

US 2018/0100329 A1 Apr. 12, 2018

Related U.S. Application Data

(63) Continuation of application No. PCT/AT2016/050144, filed on May 17, 2016.

(30) Foreign Application Priority Data

Jun. 9, 2015 (AT) ..... A 360/2015

(51) Int. Cl.
*E05F 1/10* (2006.01)
*E05F 1/16* (2006.01)
(Continued)

(52) U.S. Cl.
CPC ..... *E05B 63/22* (2013.01); *A47B 88/463* (2017.01); *E05C 19/022* (2013.01); *E05F 1/10* (2013.01); *E05F 1/16* (2013.01); *E05Y 2900/20* (2013.01)

(58) Field of Classification Search
CPC ..... A47B 88/463; A47B 88/46; A47B 88/467; E05B 63/22; E05Y 2500/20; E05F 1/10
See application file for complete search history.

(56) References Cited

U.S. PATENT DOCUMENTS 7,887,147 B2 2/2011 Karg
8,109,582 B2 2/2012 Dubach
(Continued)

FOREIGN PATENT DOCUMENTS

AT 413 933 7/2006
AT 502 324 3/2007
(Continued)

OTHER PUBLICATIONS

Machine translation of WO 2004/101919 (Year: 2018).*
(Continued)

*Primary Examiner* — Daniel J Rohroff
(74) *Attorney, Agent, or Firm* — Wenderoth, Lind & Ponack, L.L.P.

(57) ABSTRACT

A push-out device for a movable furniture part includes a rotatable push-out element for pushing out the movable furniture part from a closed position to an open position. When the movable furniture part is pushed out, the push-out element can be rotated in a rotation direction. The push-out device has a push-out force accumulator which applies force to the push-out element in the opening direction of the movable furniture part, and has a tensioning device for tensioning the push-out force accumulator by the push-out element. When the push-out force accumulator is tensioned, the push-out element can be rotated in the same rotation direction as when the movable furniture part is pushed out.

14 Claims, 20 Drawing Sheets

(51) Int. Cl.

| | |
|---|---|
| ***E05B 63/22*** | (2006.01) |
| ***E05C 19/02*** | (2006.01) |
| ***A47B 88/463*** | (2017.01) |

(56) References Cited

U.S. PATENT DOCUMENTS

| | | | | |
|---|---|---|---|---|
| 8,678,525 | B2 | 3/2014 | Karg | |
| 9,803,411 | B2 * | 10/2017 | Grabher | E05F 15/00 |
| 9,968,192 | B2 * | 5/2018 | Albrecht | A47B 88/463 |
| 2004/0017138 | A1 | 1/2004 | Mueller et al. | |
| 2004/0055221 | A1 * | 3/2004 | Hoffman | E05F 1/105 49/386 |
| 2006/0061245 | A1 * | 3/2006 | Huber | A47B 88/457 312/348.1 |
| 2007/0209157 | A1 * | 9/2007 | Kung | E05D 15/262 16/240 |
| 2008/0048538 | A1 * | 2/2008 | Karg | E05F 1/1066 312/319.2 |
| 2008/0191592 | A1 | 8/2008 | Dubach | |
| 2009/0273262 | A1 * | 11/2009 | Brustle | A47B 88/457 312/319.1 |
| 2009/0307869 | A1 | 12/2009 | Salice | |
| 2010/0037715 | A1 * | 2/2010 | Gasser | A47B 88/0477 74/27 |
| 2011/0031857 | A1 | 2/2011 | Karg | |
| 2013/0038189 | A1 * | 2/2013 | Hauer | A47B 88/457 312/319.5 |
| 2015/0374125 | A1 * | 12/2015 | Goetz | A47B 88/0477 312/319.1 |
| 2015/0377269 | A1 * | 12/2015 | Haemmerle | F16B 12/14 248/122.1 |
| 2017/0051813 | A1 * | 2/2017 | Karu | E05F 1/16 |
| 2017/0204645 | A1 * | 7/2017 | Lubetz | E05F 1/1058 |
| 2018/0087305 | A1 * | 3/2018 | Dubach | E05F 1/08 |
| 2018/0094457 | A1 * | 4/2018 | Hammerer | E05B 63/22 |
| 2018/0100338 | A1 * | 4/2018 | Dubach | E05F 1/16 |

FOREIGN PATENT DOCUMENTS

| | | | |
|---|---|---|---|
| AT | 512 699 | 10/2013 | |
| CN | 101257819 | 9/2008 | |
| CN | 102469880 | 5/2012 | |
| DE | 20 2005 002 433 | 6/2005 | |
| EP | 1 374 733 | 1/2004 | |
| EP | 1 875 021 | 1/2008 | |
| WO | WO-2004101919 A1 * | 11/2004 | E05B 17/0029 |
| WO | 2007/116572 | 10/2007 | |
| WO | 2008/031814 | 3/2008 | |

OTHER PUBLICATIONS

International Search Report dated Aug. 9, 2016 in International (PCT) Application No. PCT/AT2016/050144.

Search Report dated Mar. 7, 2016 in Austrian Application No. A 360/2015, with English translation.

English translation of Search Report issued with Chinese Office Action dated Nov. 20, 2018.

* cited by examiner

SS+VS+K

ÜS+ES+K

OS+ES+K

OS+ES+K

OS + ES + K

OS + ES + K

OS+ES+K

OS+ES+K

OS+ES+K

OS+VS+K

OS+VS+EK

OS+VS+EK+R

SS+VS+K+R

SS+VS+EK

ÜS+ES+EK

OS+ES+EK

OS+ES+EK

OS+ES+K

OS+ES+K

OS + ES + K

OS + ES + K

OS+ES+K

OS+VS+EK

OS+VS+EK

OS+VS+EK

SS+VS+EK

OS+VS+EK+R

PUSH-OUT DEVICE FOR A MOVABLE FURNITURE PART

BACKGROUND OF THE INVENTION

The invention concerns an ejection device for a movable furniture part, comprising a rotatable ejection element for ejecting the movable furniture part from a closed position into an open position, configured so that when the movable furniture part is ejected, the ejection element can be rotated in a rotary direction. A force storage member is provided for force-actuating the ejection element in opening direction of the movable furniture part, and a tensioning device is provided for tensioning the ejection force storage member by the ejection element. Moreover, the invention concerns an item of furniture with a furniture carcass, a movable furniture part and such an ejection device.

For many years, various kinds of ejection devices for movable furniture parts, for example drawers, doors, or furniture flaps, have been produced and sold in the industrial field of furniture fittings. Such ejection devices are often referred to as touch-latch-mechanisms or as tip-on-devices. A linear movement of the furniture part in the case of drawers or a swiveling movement in the case of furniture flaps or furniture doors is triggered with such ejection devices. The movement carried out in the ejection device does not have to match necessarily with the movement path carried out by the movable furniture part. For this reason, a displaceable ejection element can certainly eject a pivotable furniture door or vice versa.

The EP 1 875 021 B1 shows a pivotally or rotatably supported ejection element directly force-actuating a furniture door. When opening, the ejection element pivots in a force-actuated manner in a rotary direction. In order to again tension the ejection force storage member, the ejection element is pressed by the furniture door when closing. As a result, the ejection element is rotated opposite to the initial rotary direction and, thereby, the ejection force storage member is again tensioned. Among other things, a disadvantage associated with this configuration is that the ejection element still remains in an ejection position when the furniture door is completely opened. Thus, this ejection device can stand in the way when stowing utensils in the item of furniture. It can also be disadvantageous in the optional case of an additionally present retracting device because the ejection force storage member is only being tensioned again when closing.

SUMMARY OF THE INVENTION

Thus, the object of the present invention is to provide an improved or alternative ejection device compared to the prior art.

According to the invention, when the ejection force storage member is tensioned, the ejection element can be rotated in the same rotary direction as when the movable furniture part is ejected. In other words, after the ejecting, the ejection element is simply rotated further in the same direction also when tensioning. Therefore, one does not have to wait until the movable furniture part is again moved into the closing direction for the tensioning.

In principle, it is possible that the ejection element is rotated only about a relative small section when tensioning (e. g. one-eighth turn), whereas the ejection element is rotated about a larger section when ejecting (e. g. a three-quarter turn). In order to still introduce the necessary force into the ejection force storage member, various transmission mechanisms can be provided. Thus, it is not necessary that the ejection element is rotated about the same angular value when tensioning and when ejecting. It is also not necessary that the ejection element is rotated in total around 360° when tensioning and when ejecting. This can also only be carried out for part sections, e. g. for a quarter turn each. For a simple construction, however, it is preferably provided that the ejection element, when ejecting the movable furniture part and when tensioning the ejection force storage member, in total travels a rotary path in form of a full revolution. The ejection element substantially travels one half of a full revolution when ejecting the movable furniture part, and substantially travels the other half of the rotary path when subsequently tensioning the ejection force storage member.

The movable furniture part is movable along a furniture part opening path when ejecting. This furniture part opening path can be linear (mostly in the case of drawers) or curve-shaped (for example in the case of furniture doors or furniture flaps). The ejection path of the ejection device can be substantially identical to the furniture part opening path of the movable furniture part and can also be linear (for example in the case of an ejection piston) or curve-shaped (for example in the case of an ejection lever). It is also possible that the ejection path of the ejection device is linear, while the furniture part opening path of the movable furniture part describes a curve.

Independent from the exact design of the furniture part opening path or from the ejection path, however, preferably the ejection element can be rotated about a rotary axis, the rotary axis being oriented transversely to the ejection path of the ejection device. The deviation of the rotary axis from the ejection path can reach for example 45° or 60°. Particularly, the ejection element can be rotated about a rotary axis being oriented substantially rectangular to the ejection path. In this case "substantially" means that, in the case of an ejection path describing a curve, the rectangular orientation is only given at the very beginning of the ejection path. In the further progress of the ejection path, the orientation of the rotary axis deviates more and more from the rectangular orientation of the ejection path.

For an easy mounting of the ejection device, a carrier is preferably provided. This carrier comprises, for example, a mounting plate and a cover, whereby the whole ejection device can be arranged so as to be protected in the carrier formed as a housing. When there is such a carrier, preferably the ejection force storage member on the one hand engages the carrier and on the other hand engages the ejection element.

In order to enable a movement transmission from the movable furniture part onto the ejection device or vice versa, preferably the tensioning device can be coupled to the movable furniture part by a coupling device.

In principle, it shall not be excluded that the tensioning of the ejection force storage member is carried out during closing—thus when pressing onto the movable furniture part. Preferably, however, the ejection force storage member can be tensioned by the tensioning device by pulling the movable furniture part in the opening direction. Preferably, this pulling tensioning movement directly follows the ejection movement.

The ejection element can be that part of an ejection device which also directly abuts the movable furniture part. According to a preferred embodiment, however, it is provided that the movable furniture part can be indirectly moved in an open position by the ejection element via a tensioning element of the tensioning device. The tensioning element, thus, forms that part which is directly actuated by the ejection force storage member. The transmission of the rotary movement of the ejection element onto the movable furniture part can be carried out via one or several components arranged therebetween (e. g. a translation mechanism).

If the ejection force storage member is tensioned when pulling, a retrieving force storage member for moving the tensioning device into a retrieved position is preferably provided.

Further, a locking device for locking the ejection element in a locking position is preferably provided. The locking device can be unlocked by over-pressing the movable furniture part into an over-pressing position located behind the closed position. Such locking devices can be formed, for example, in the form of a control pin movable in a cardioid-shaped sliding guide track. A dead center locking is provided according to a preferred embodiment.

The invention also relates to an item of furniture with a furniture carcass, a movable furniture part (for example in the form of a furniture door, a furniture flap or a drawer), and an ejection device according to the invention for the movable furniture part. Such an item of furniture still can additionally comprise a, preferably damped, retraction device.

BRIEF DESCRIPTION OF THE DRAWINGS

Further details and advantages of the present invention are described more fully hereinafter by the specific description with reference to the embodiments illustrated in the drawings, in which.

DETAILED DESCRIPTION OF THE INVENTION

Figure 1:
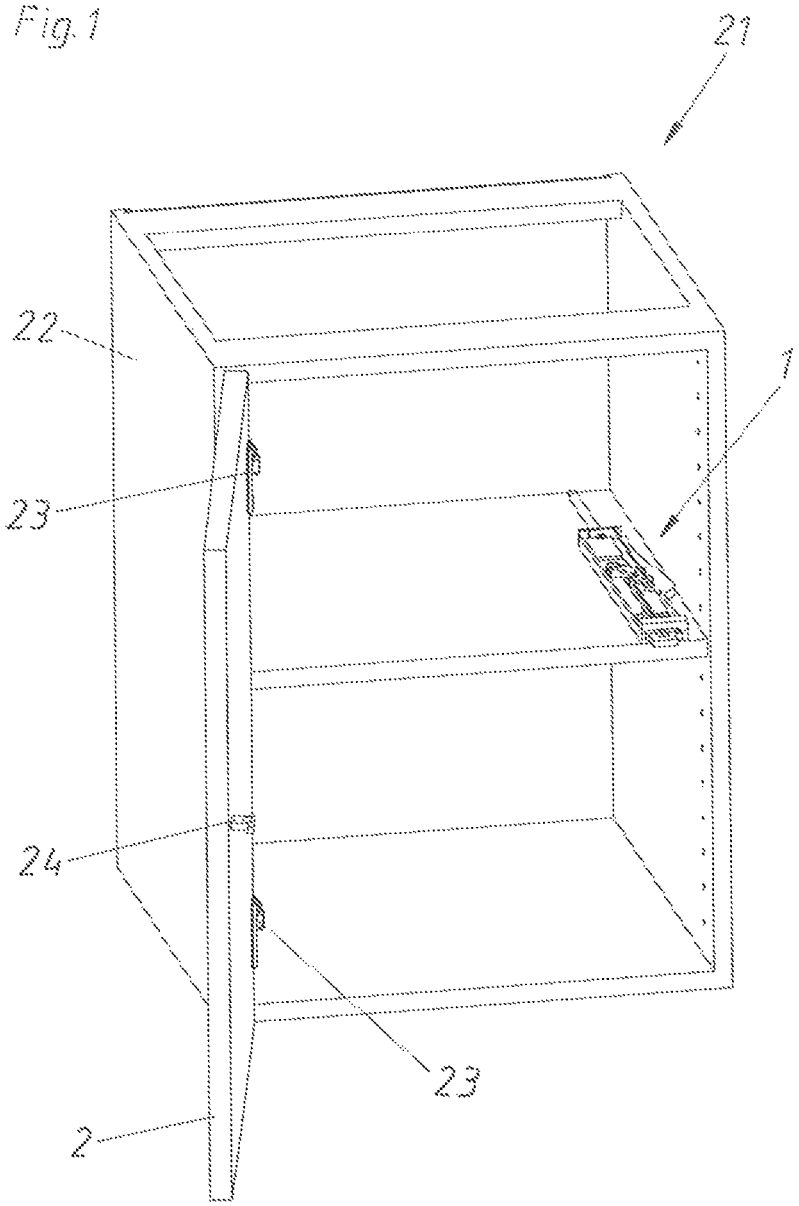
FIG. 1 shows an item of furniture with an ejection device according to a first embodiment.

FIG. 1 shows an item of furniture 21 with a furniture carcass 22 and a movable furniture part 2 in form of a furniture door. This movable furniture part 2 is pivotally supported by two hinges 23 on the furniture carcass 22 about a vertical axis. A damping device (not shown) for a closing movement can be integrated in at least one of the hinges 23. An ejection device 1 according to a first embodiment is arranged on the furniture carcass 22. The coupling counter piece 24 of this ejection device 1 is fixed to the movable furniture part 2. Only for the purpose of illustration this coupling counter piece 24 is also directly drawn in the area of the ejection device 1. Of course, only the coupling counter piece 24 on the movable furniture part 2 is actually present. Basically, it is possible with all embodiments that the ejection device 1 is arranged on the movable furniture part and the coupling counter piece 24 is arranged or formed on the furniture carcass 22. As a consequence, the ejection device 1 so to speak pushes itself from the furniture carcass 22.

Figure 2:
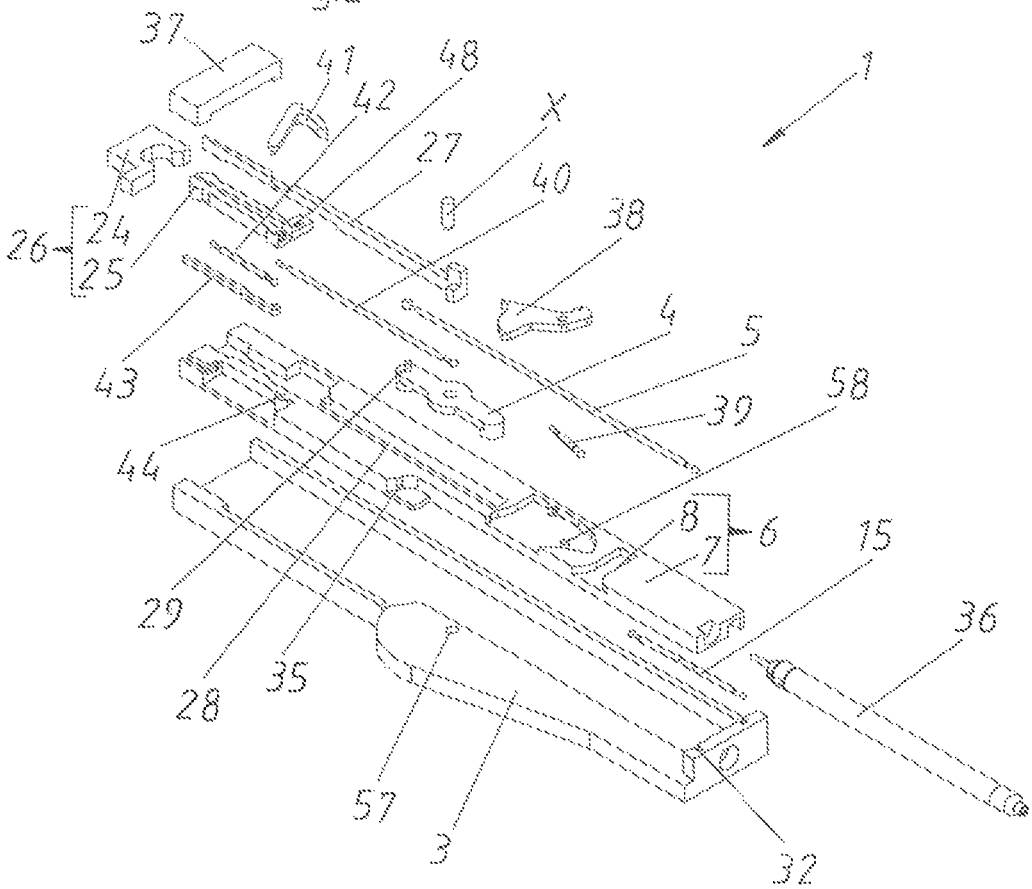
FIG. 2 is an exploded view of the ejection device according to the first embodiment.

In FIG. 2, the ejection device 1 according to the first embodiment is shown in an exploded view. This ejection device 1 comprises a carrier 3 as a base element by way of which the ejection device 1 is mounted to the item of furniture 21. This carrier 3 together with a cover (not shown) can form a housing for the remaining components of the ejection device 1. A tensioning element 7 is displacably supported in the carrier 3. The displacing movement of this tensioning element 7 is damped by the damping device 36. The retrieving force storage member 15 on the one hand engages the tensioning element 7 and on the other hand engages the carrier 3. The tensioning element 7 together with the movement transmission element 8 formed as an abutment form the tensioning device 6. Further, an ejection element 4 is rotatably supported about the rotary axis X in the rotary bearing 57 of the carrier 3. The ejection force storage member 5 formed as a tension spring on the one hand engages the ejection element 4 via the ejection element force storage member base 29 and on the other hand engages the carrier force storage base 32 of the carrier 3. The deflection element 38 is pivotally supported on the tensioning element 7 via the rotary bearing pin 58. A deflection force storage member 39 formed as a tension spring is additionally provided between the deflection element 38 and the tensioning element 7. Further, a coupling device 26 is provided. This coupling device 26 is mainly formed by the coupling piece 25 and the coupling counter piece 26. The coupling piece 25 is displacably supported in the guide track 28 of the tensioning element 7. Also the coupling and decoupling element 27 is displacably arranged in this guide track 28. Moreover, a coupling lever 41 is provided which is rotatably supported in the rotary bearing 44 of the tensioning element 7 and which on the one hand is guided in the elongated hole of the coupling piece 25 and on the other hand is hingedly connected to an end of the coupling counter piece abutment 43. Further, a coupling force storage member 40 formed as a tension spring is provided which on the one hand engages the coupling and decoupling element 27 and on the other hand engages the coupling piece 25. Moreover, a coupling lever force storage member 42 also formed as a tension spring is provided. This coupling lever force storage member 42 on the one hand engages the coupling lever 41 and on the other hand engages the tensioning element 7. Further, a head portion 37 is provided which can be connected to the carrier 3.

Figure 3:
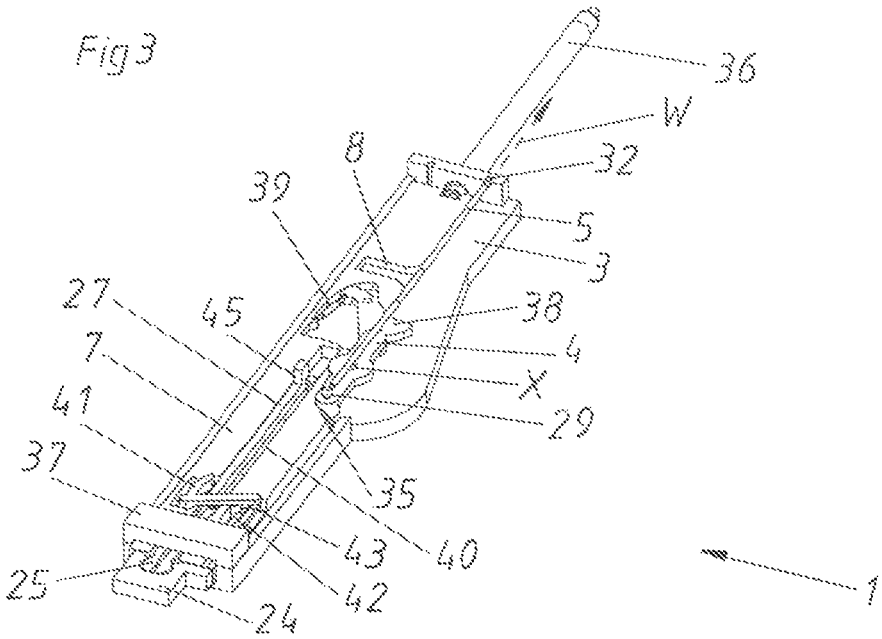
FIG. 3 shows this ejection device in an assembled state.

FIG. 3 shows the ejection device 1 according to the first embodiment in an assembled state. Already in this illustration according to FIG. 3, it can be recognized well that the carrier force storage member base 32 and the ejection element force storage member base 29 are located in a plane comprising the rotary axis X of the ejection element 4 and the line of action W. Further, the abutment 45 formed on the coupling and decoupling element 27 is also visible. It can also be recognized in this FIG. 3 that the ejection element 4 abuts the triggering device 35 formed as an abutment on the tensioning element 7.

Figure 4:
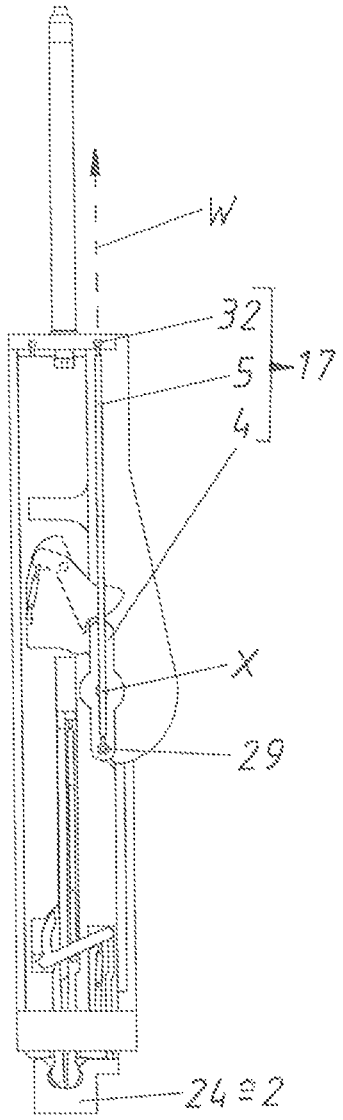
FIGS. 4 to 20 show the movement sequence during the ejection and tensioning of the ejection device according to the first embodiment.

FIG. 4 shows a top view of the ejection device 1 according to FIG. 3. The coupling counter piece 24 attached to the movable furniture part 2 represents the position of the movable furniture part 2. Accordingly, the movable furniture part is located in a closed position SS. The locking device 17 is situated in the locking position VS in which the line of action W of the ejection force storage member 5 is running through the rotary axis X. The direction of action of the line of action W is indicated by the arrow and points in closing direction SR. As this line of action W leads through the rotary axis X, the force of the tensioned ejection force storage member 5 cannot unfold. Therefore, the ejection element 4 is held so to speak in a dead center. The carrier force storage member base 32 (together with the carrier 3), the ejection force storage member 5 and the ejection element 4, thus, together form the locking device 17. The coupling device 26 is situated in the coupling position K as the coupling piece 25 is coupled to the coupling counter piece 24.

Figure 5:
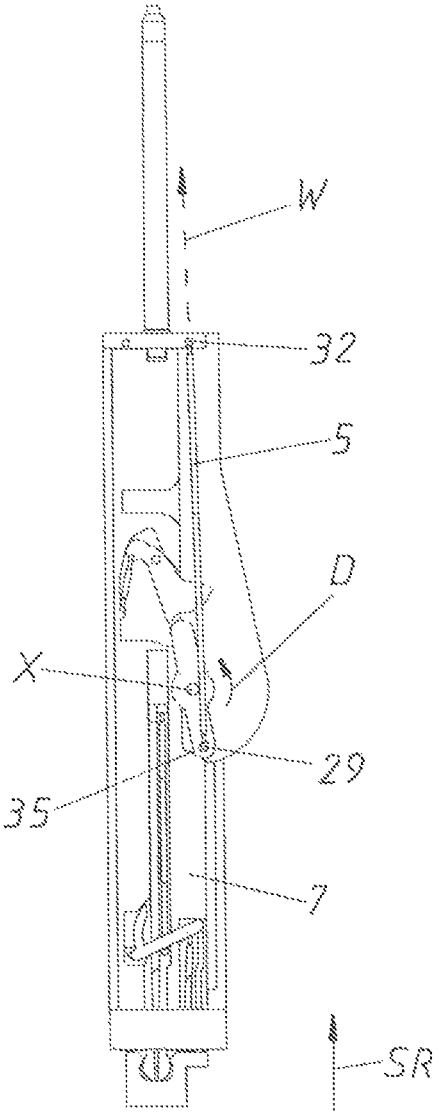

When the movable furniture part 2 is pressed in closing direction SR starting from this position according to FIG. 4, this movable furniture part 2 reaches the over-pressing position ÜS according to FIG. 5. As a consequence, the tensioning element 7 is also moved in closing direction SR by the coupling counter piece 24, whereby the abutment of the triggering device 35 rotates the ejection element 4 in the rotary direction D—thus counterclockwise—about the rotary axis X. As a consequence of this over-pressing, the rotary axis X and the line of action W are therefore distanced from each other and reach a relative unlocking state ES. Hence, the locking device 17 is unlocked.

Figure 6:
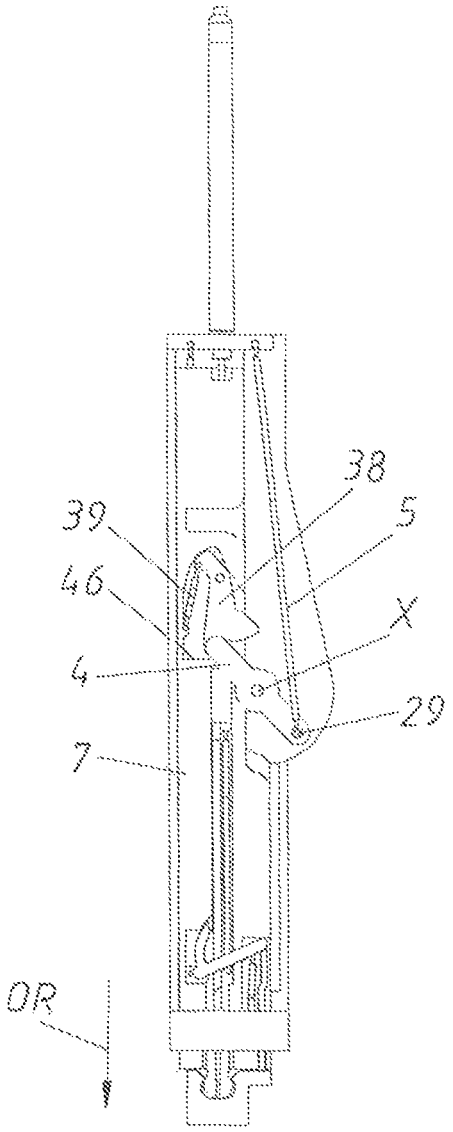

The ejection force storage member 5 can relax starting from this unlocking state ES according to FIG. 5, whereby the ejection element 4 further rotates in rotary direction D (see FIG. 6). As a consequence, the end of the ejection element 4 remote from the ejection element force storage member base 29 reaches contact with the ejection abutment 46 formed on the tensioning element 7. This causes the whole tensioning element 7 to be moved in the opening direction OR relative to the carrier 3, whereby the movable furniture part 2 in turn reaches an—albeit still marginal—open position OS. At the same time, the ejection element 4 also pivots the deflection element 38 clockwise against the force of the deflection force storage member 39.

Figure 7:
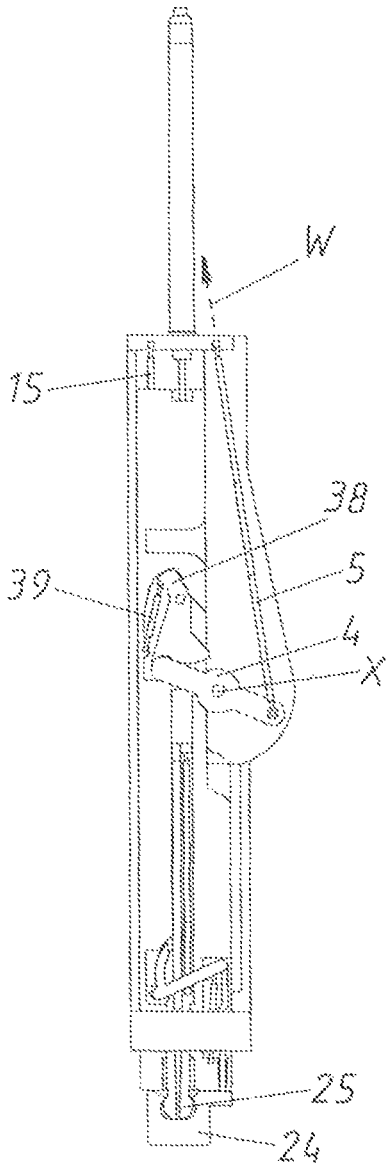

The ejection force storage member 5 is still further relaxed in FIG. 7, whereby the movable furniture part 2 (represented by the coupling counter piece 24) is moved still further into an open position OS. Thus, the movable furniture part 2 is indirectly ejected by the ejection element 4 by the tensioning element 7 and the coupling piece 25. As the tensioning element 7 is moving in the opening direction OR, the retrieving force storage member 15 formed as a tension spring starts to tension.

Figure 8:
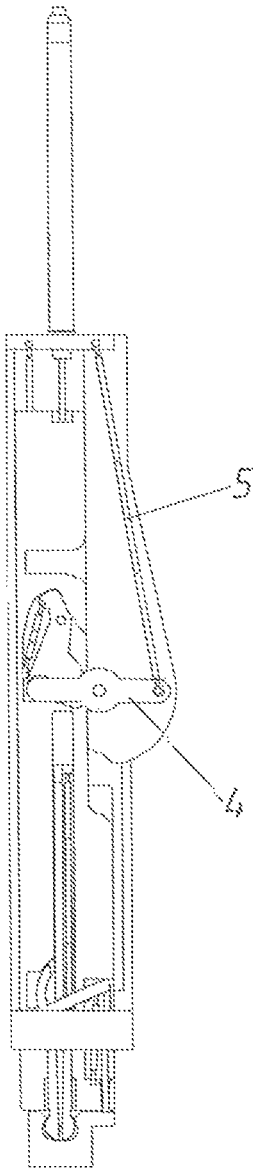

In FIG. 8 a quarter turn of the ejection element 4 is completed. The ejection force storage member 5 has already relaxed substantially halfway. The movable furniture part 2 is located in an open position OS, the locking device 17 is in the unlocking state ES and the coupling device 26 is the coupling position K. The deflection force storage member 39 is fully tensioned.

Figure 9:
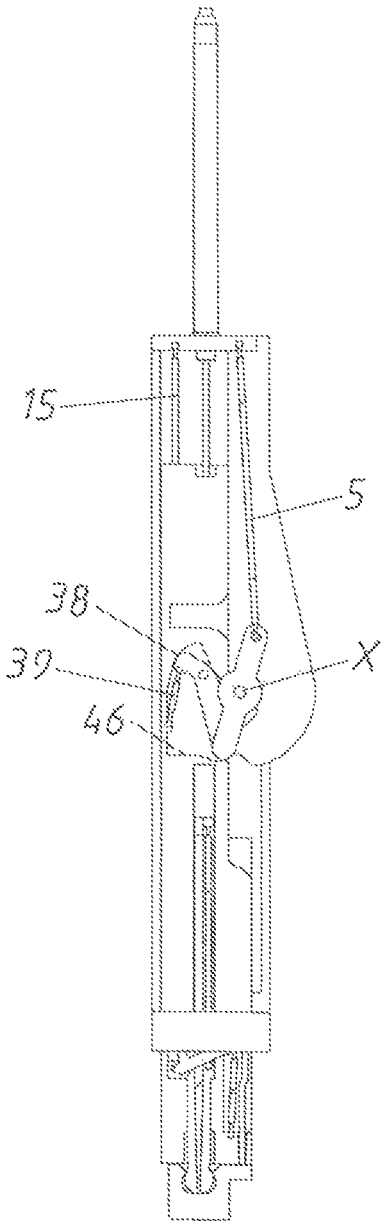

As the ejection element 4 has already moved further according to FIG. 9, also the end of the ejection element 4 remote from the ejection element force storage member base 29 is again being oppositely moved (i. e. in this case to the right). As a consequence, also the deflection force storage member 39 is again relaxed, whereby the deflection element 38 follows the ejection element 4.

Figure 10:
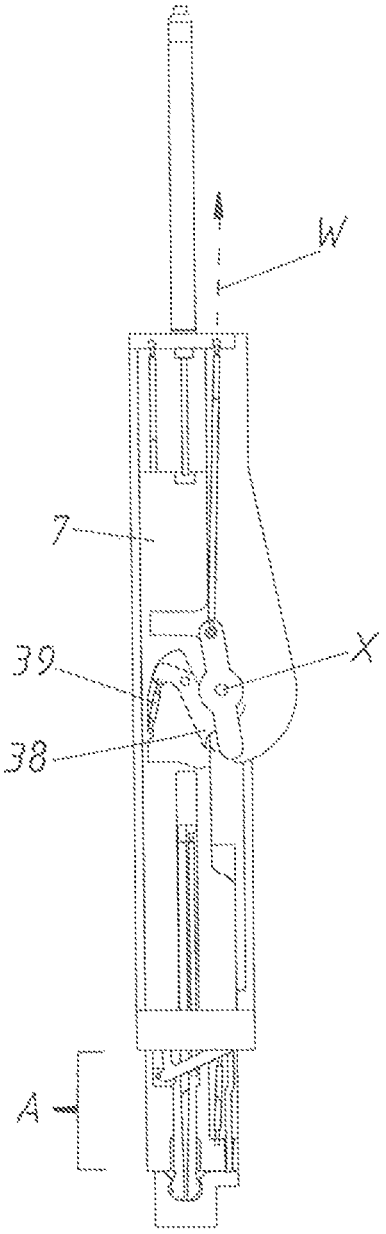
Figure 11:
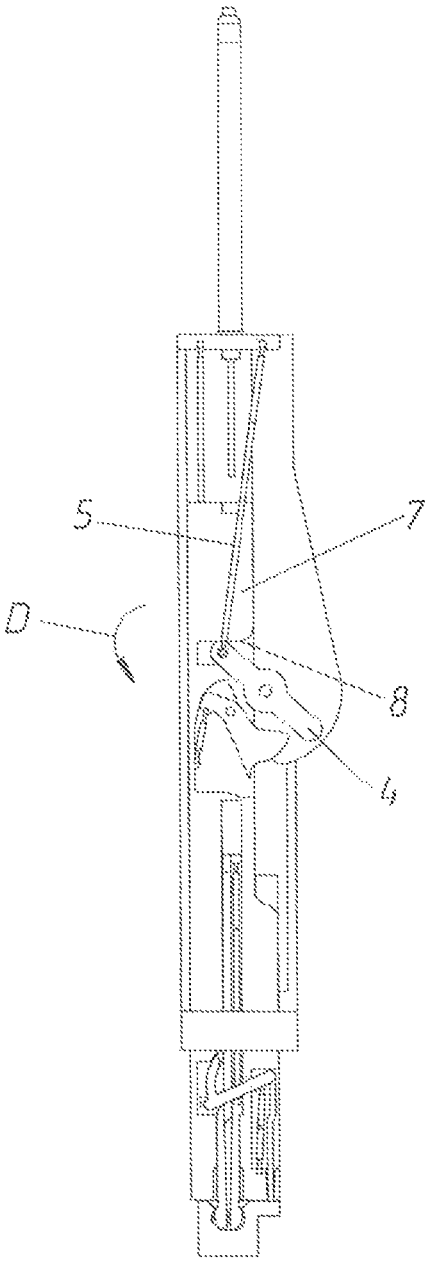

The ejection device 1 reaches a position (not shown) between the FIGS. 9 and 10, in which a dead center opposite from the locking position VS is reached. In this position in a top view, the carrier force storage member base 32, the ejection element force storage member base 29, and the rotary axis X are arranged in one line. The deflection force storage member 39, however, is further relaxing in order to still further move the ejection element 4 starting from this neutral state or dead center state, whereby the deflection element 38 moves the ejection element 4 into the position according to FIG. 10. In this position, the ejection path A of the ejection device 1 is completed. Starting with this position, the tensioning path S begins, in which the movable furniture part 2 is actively being pulled. As the tensioning element 7 is coupled to the movable furniture part 2 by the coupling device 26, the ejection element 4 is also moved in the opening direction OR by the movement transmission element 8 formed as an abutment (see FIG. 11). As a consequence, when tensioning the ejection force storage member 5, the ejection element 4 is rotated in the same rotary direction D (counterclockwise) as when ejecting the movable furniture part 2.

Figure 12:
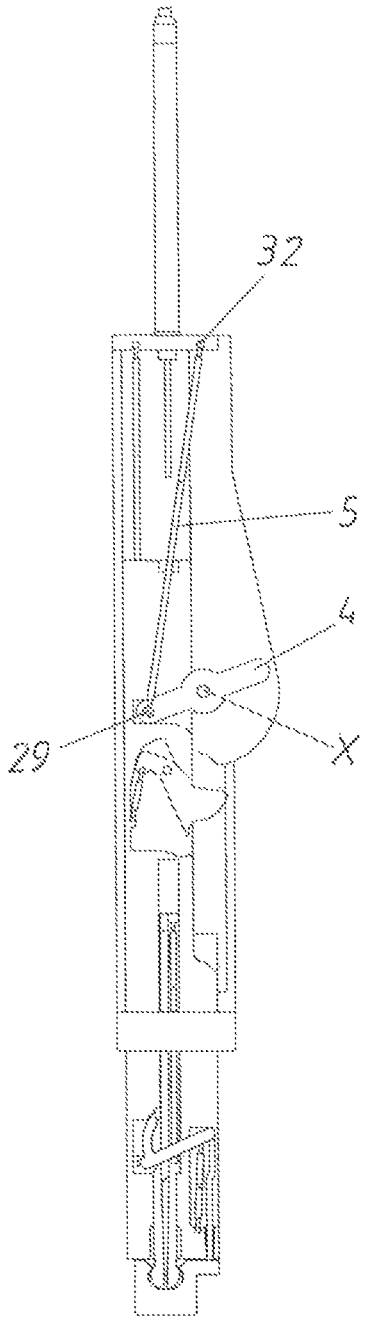

According to FIG. 12, the ejection element 4 has still further rotated in the rotary direction D about the rotary axis X by the movement transmission element 8.

Figure 13:
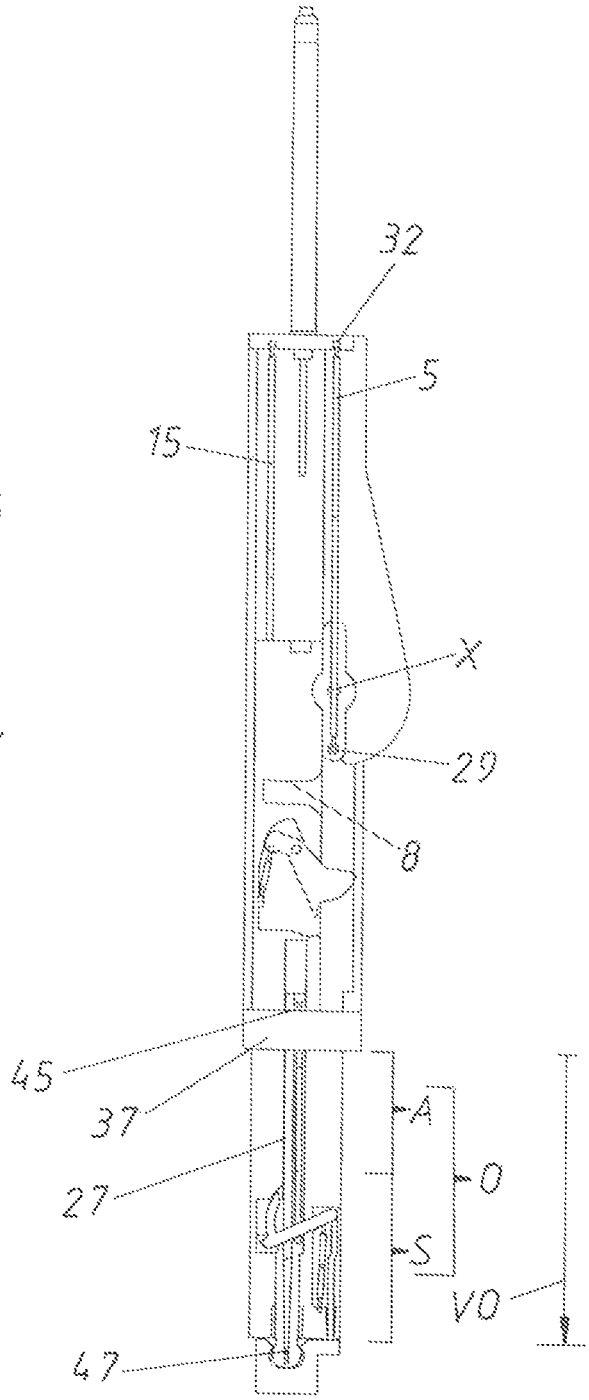

In FIG. 13, the tension path S of the tensioning device 6 is finally completed. Hence, the ejection device 1 has moved along the opening path O (consists of the ejection path A and the tensioning path S) in the opening direction OR. At the same time, the ejection element 4 has also carried out a full revolution, whereby the locking position VS is reached again, in which the line of action W of the ejection force storage member 5 is running through the rotary axis 5. The retrieving force storage member 15 is fully loaded. The abutment 45 on the coupling and decoupling element 27 abuts the head portion 37, whereby the predetermined opening path VO for the control device formed by the coupling and decoupling element 27 for the coupling device 26 is reached or travelled. The tip 47 of the coupling and decoupling element 27 is still located in the foremost region of the coupling piece 25, whereby the head region of the coupling piece 25 is still spread or whereby the two projections of the head region, which are distanced from each other by a gap, cannot be bent to each other. The coupling position K between the head region of the coupling piece 25 and the receiving region of the coupling counter piece 24 is provided by a positive-locking engagement.

Figure 14:
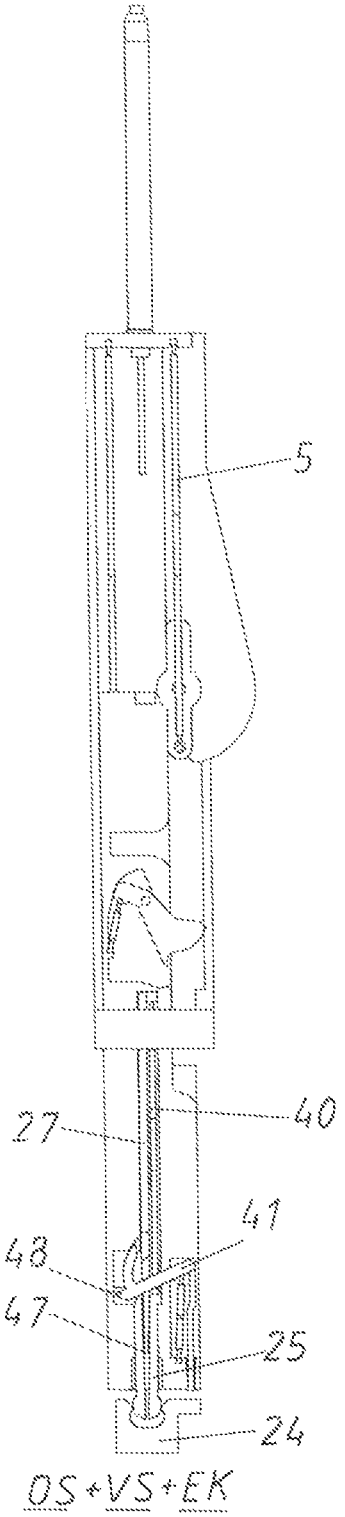

When further pulling the movable furniture part 2 starting from this position according to FIG. 13, a travel-controlled uncoupling of the coupling device 26 takes place (see FIG. 14). Initially, the tensioning element 7 is further being moved in the opening direction OR by means of the coupling piece 25. As the coupling and decoupling element 27 forming the control device, however, abuts the head portion 37, only the coupling piece 25 together with the tensioning element 7 is moving relative to the carrier 3 in the opening direction OR. As a consequence, the tip 47 of the coupling and decoupling device 27 is removed from the head region of the coupling piece 25, whereby this head region is less strong or no longer spread. Thus, the projections of the head region can bend to each other. Thereby, the decoupling position EK is reached and there is only a loose connection between the head region of the coupling piece 25 and the receiving region of the coupling counter piece 24. Thus, the no longer spread coupling piece 25 can already be released from the coupling counter piece 24 according to FIG. 14. During the relative movement of the coupling and decoupling element 27 to the coupling piece 25 also the coupling force storage member 40 is tensioned as this coupling force storage member 40 on the one hand engages the coupling piece 25 and on the other hand engages the coupling and decoupling element 27.

The movable furniture part 2 is freewheeling as soon as the coupling counter piece 24 is completely released from the coupling piece 25. At the same time, the coupling force storage member 40 can also again relax, whereby the coupling piece 25 is moved relative to the tensioning element 7 in the closing direction SR. As a consequence, the coupling lever 41 is also pivoted about the rotary bearing 44. With this movement also the coupling counter piece abutment 43 is being moved beyond the tensioning element 7 while the coupling lever force storage member 42 is relaxing. When the coupling piece 25 is moved back, the head region of the coupling piece 25 arrives between the side walls of the coupling piece guide 49, whereby the parts of the head region of the coupling piece 25 distanced from each other are pressed towards each other. As a consequence, the tip 47 of the coupling and decoupling element 27 cannot move all the way forward into the coupling piece 25. The coupling force storage member 40, thus, cannot be fully tensioned, but only about halfway.

Figure 16:
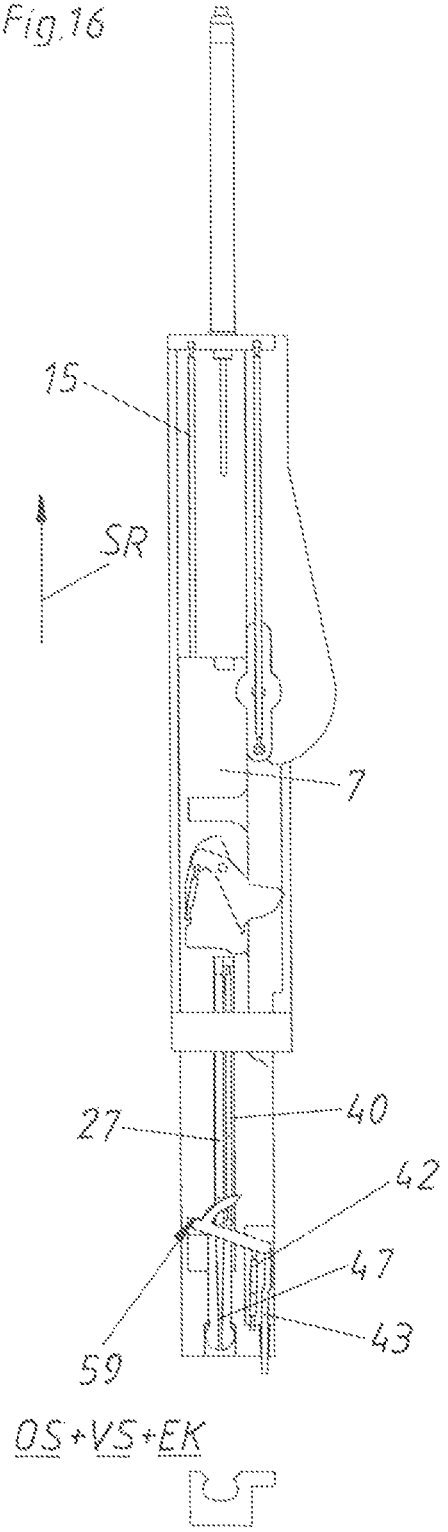

However, in order to still move the coupling piece 25 all the way into the coupling piece guide 49, the coupling lever force storage member 42 relaxes according to FIG. 16 and pivots the coupling lever 41 till the coupling piece 25 abuts the abutment 59 of the tensioning element 7. As a consequence, also the coupling counter piece abutment 43 is fully extended. The tip 47 of the coupling and decoupling element 27 is not yet completely in the foremost region of the coupling piece 25.

Figure 15:
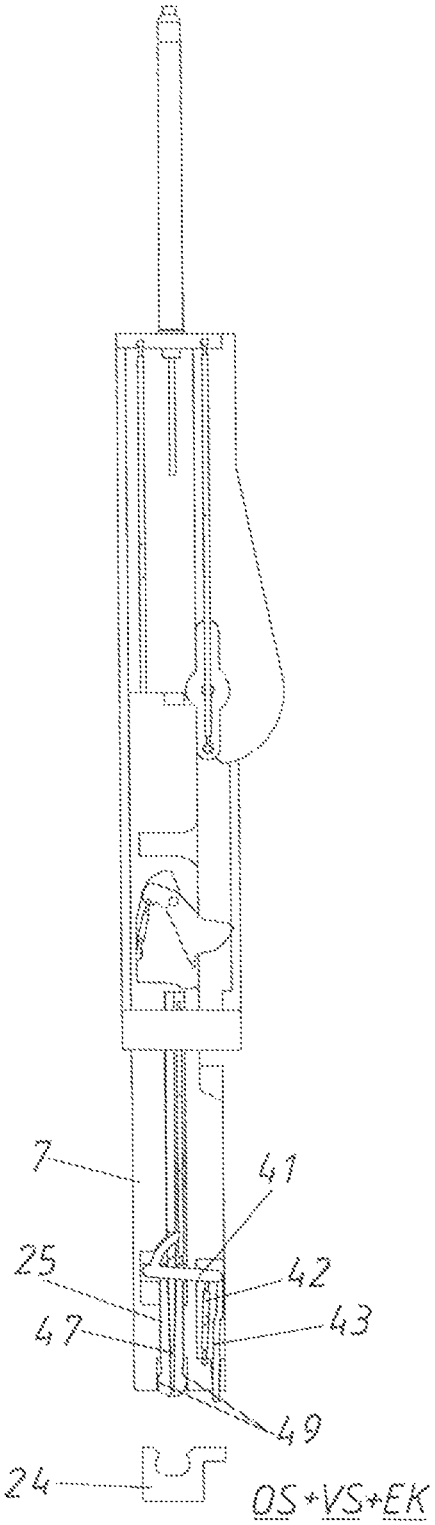
Figure 17:
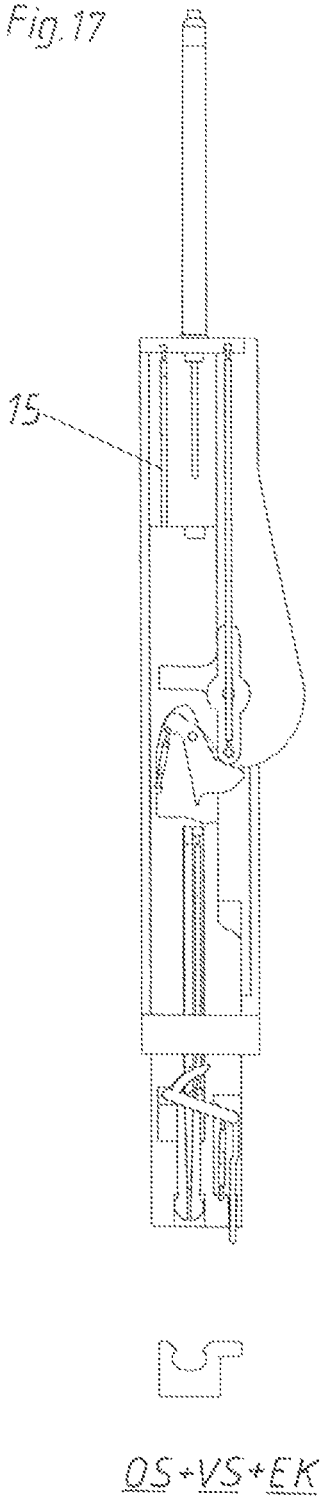

Starting from FIG. 16, respectively already starting from FIG. 15, the retrieving force storage member 15 also begins to relax, whereby the position according to FIG. 17 is initially reached.

Figure 18:
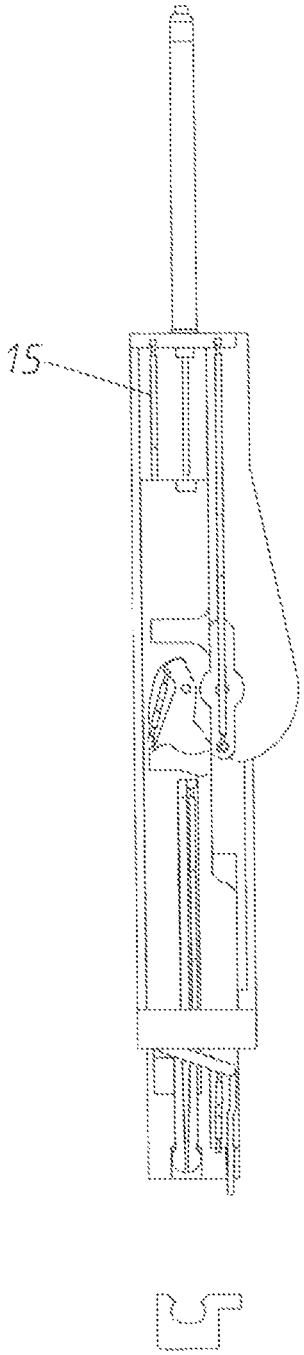
Figure 19:
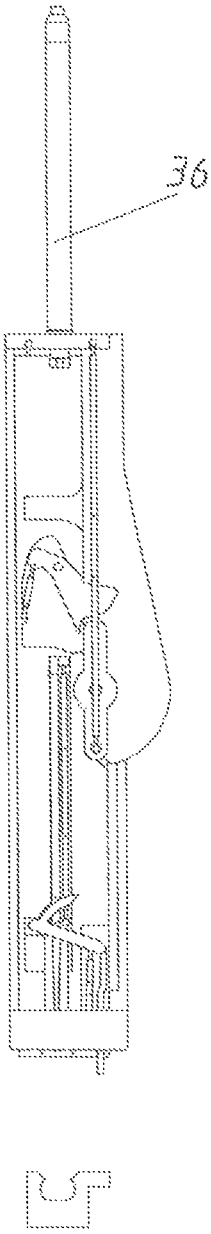

Subsequently, the tensioning element 7 is further moved back until the position shown in FIG. 18 by the relaxing retrieving force storage member 15. Finally, the retrieved position R in FIG. 19 is reached. This retrieving movement from FIG. 18 to FIG. 19 is damped by the damping device 36. The movable furniture part 2 is still in an open position OS. The locking device 17 is in the locking position VS.

Figure 20:
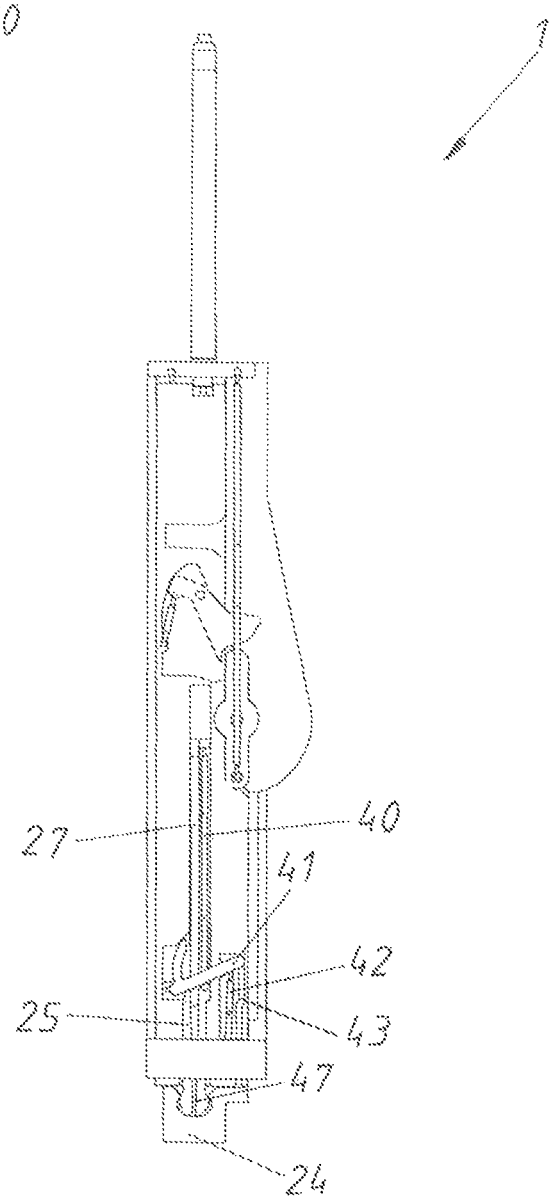

When finally also the movable furniture part 2 is being closed according to FIG. 20, the coupling counter piece 24 initially reaches contact with the coupling counter piece abutment 43. As a consequence, the coupling piece 25 is initially moved in the opening direction OR by the rotary movement of the coupling lever 41, whereby the initially non-spread head region of the coupling piece 25 engages the receiving region of the coupling counter piece 24. As then the coupling piece 25 is no longer held between the side surfaces of the coupling piece guide 49 in a narrowing manner, also the coupling force storage member 40 has relaxed according to FIG. 20, whereby the tip 47 of the coupling and decoupling element 27 has again fully penetrated the head region of the coupling piece 25 and, thus, has spread this head region. Hence, the coupling position K of the coupling device 26 is again reached in FIG. 20. This FIG. 20 corresponds again to the starting position according to FIG. 4.

Figure 21:
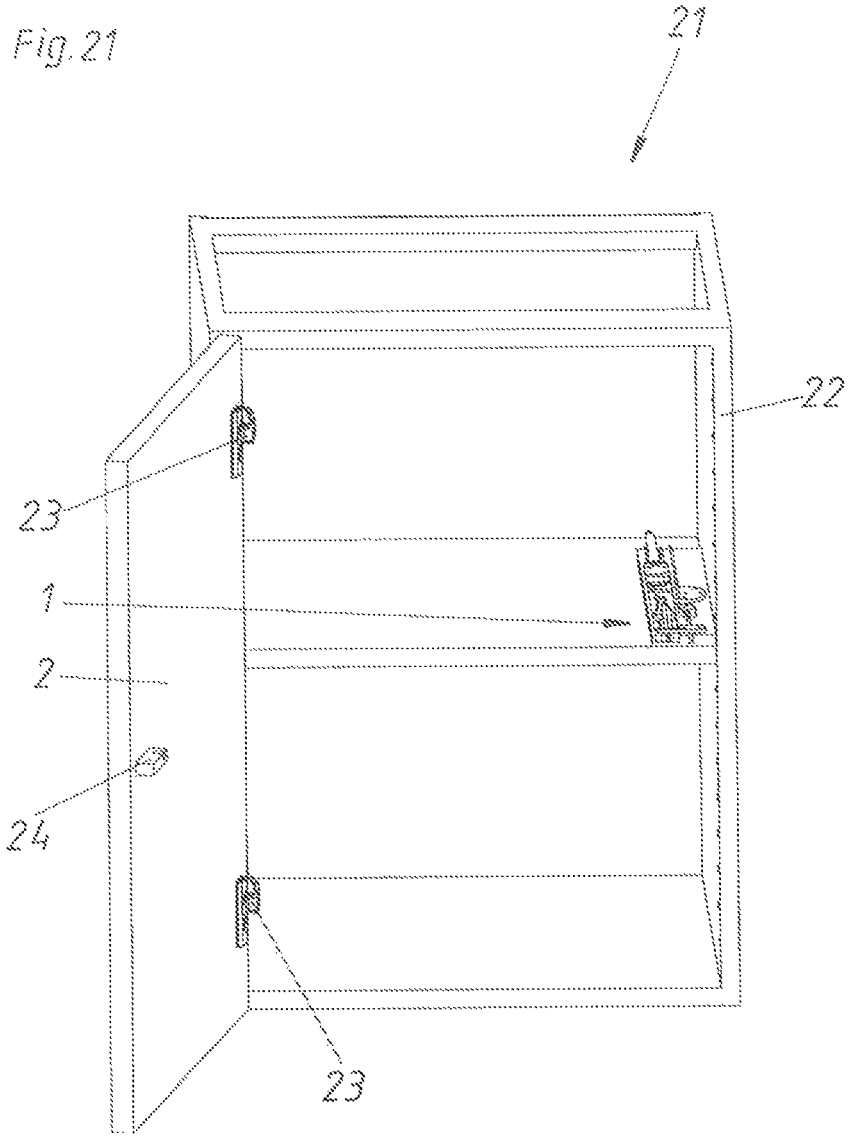
FIG. 21 shows an item of furniture with an ejection device according to a second embodiment.

FIG. 21 shows an item of furniture 21 comprising a furniture carcass 22 and a movable furniture part 2 with a second embodiment of an ejection device 1. Also in this case, the movable furniture part is again hingedly connected to the furniture carcass 22 by hinges 23. The coupling counter piece 24 of the ejection device 1 is mounted to the movable furniture part 2.

Figure 22:
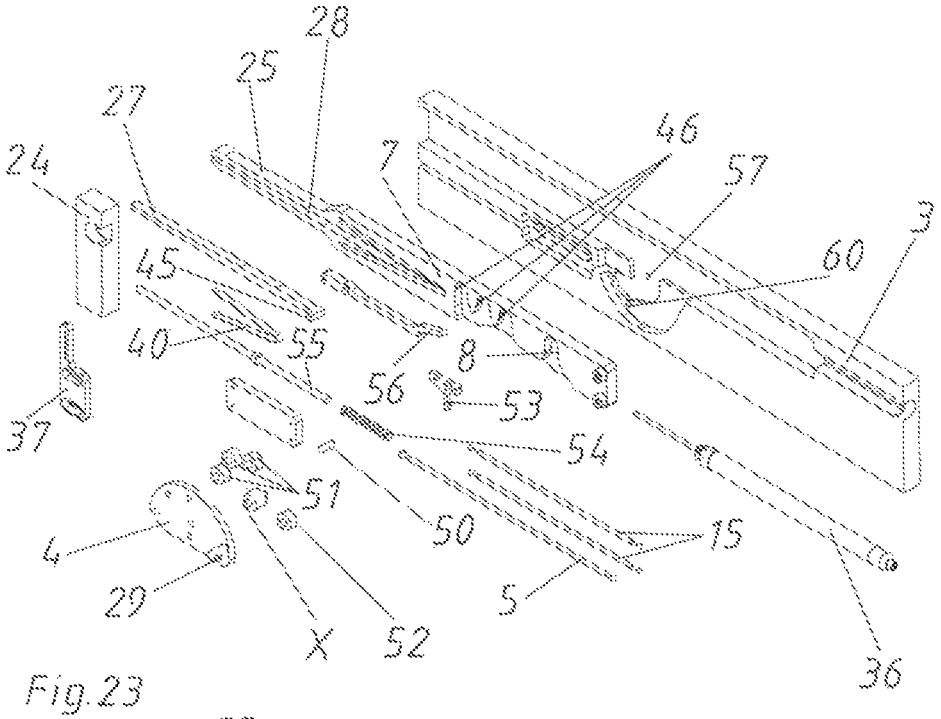
FIG. 22 is an exploded view of the ejection device according to the second embodiment.

The second embodiment of the ejection device 1 is shown in detail in the exploded view according to FIG. 22. Again, the ejection device 1 comprises a carrier 3 which forms—together with a cover (not shown)—a housing for the remaining components of the ejection device. The tensioning element 7 is displaceably supported in the carrier 3.

This tensioning element 7 is movably supported on the carrier 3 in a damped manner by means of a damping device 36. The tensioning element 7 is connected to the carrier 3 by means of a retrieving force storage member 15. A guide track 28 for the coupling and decoupling element 27 is provided in the tensioning element 7. This coupling and decoupling element 27 is prestressed to the left against the tensioning element 7 by means of a coupling force storage member 40. In this case, the coupling force storage member 40 is formed as a V-formed tension spring, wherein the tension spring is held with its ends in the tensioning element 7 and abuts the coupling and decoupling element 27 in a central region. Further, a coupling element tensioner 56 connected to the carrier 3 is provided, the coupling element tensioner 56 can abut the abutment 45 of the coupling and decoupling element 27. Moreover, also in the embodiment a head portion 37 is mounted to the carrier 3. In total three ejection abutments 46 are provided in the tensioning element 7, the ejection abutments 46 correspond to the ejection rollers 51 arranged on the ejection element 4. The ejection element 4 itself is rotatably supported in the rotary bearing 57 of the carrier 3 about the rotary axis X. In addition, a tensioning roller 52 is arranged on the ejection element 4. An eccentric pin 50 is eccentrically arranged on the ejection element 4. The ejection force storage member 5 is connected on the one hand to the ejection element 4 by means of the ejection element force storage member base 29 and is connected on the other hand to the carrier 3 by means of the carrier force storage member base 32. Further, also a triggering device 35 is provided. In this embodiment the triggering device 35 is formed by the triggering element 55, the triggering spring 54 and the triggering bracket 53. This triggering bracket 53 is held in the recess 60 of the carrier 3.

Figure 23:
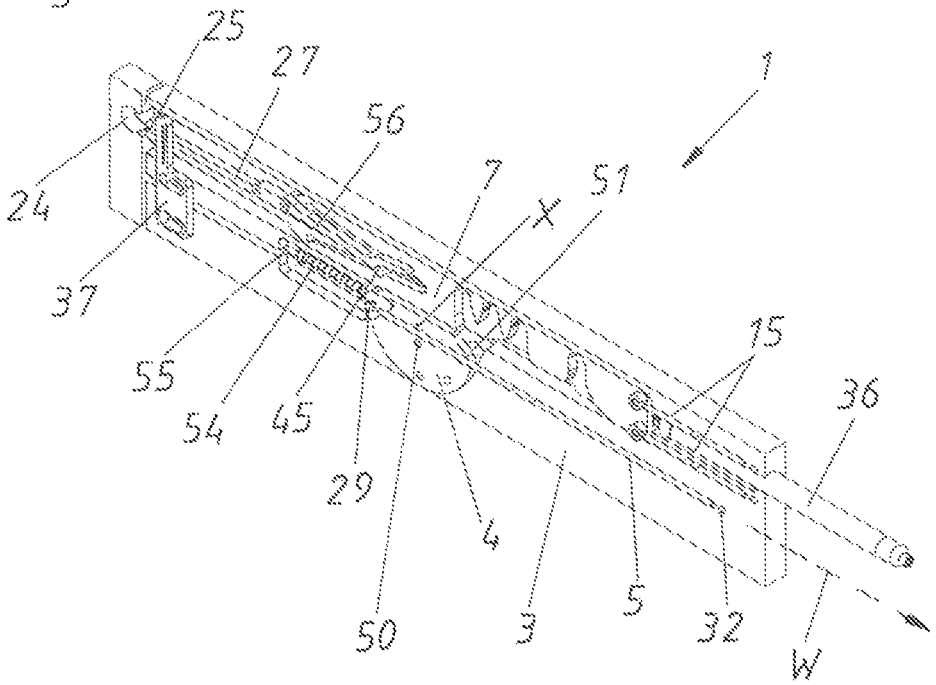
FIG. 23 shows the ejection device in an assembled state.

In FIG. 23 the second embodiment of the ejection device 1 is shown in an assembled state. Here, the abutment 45 of the coupling and decoupling element 27 abuts the coupling element tensioner 56. Moreover, it can be seen that in the shown locking position VS the carrier force storage member base 32 and the ejection element force storage member base 29 are located in a plane comprising the rotary axis X of the ejection element 4 and the line of action W.

Figure 24:
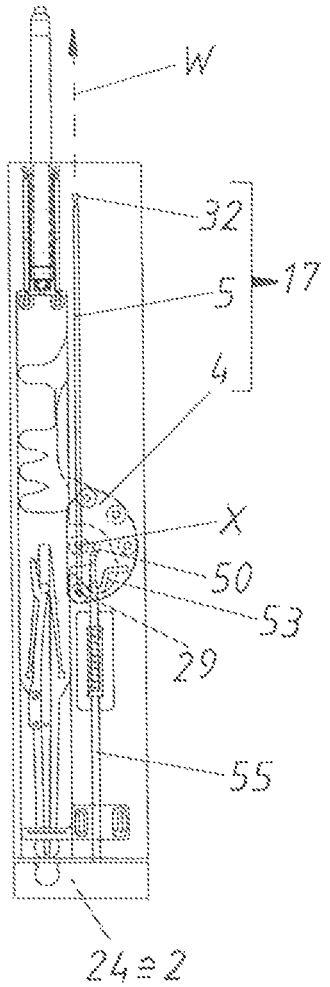
FIGS. 24 to 37 show the movement sequence of the ejection device according to the second embodiment.

FIG. 24 shows a top view of the ejection device 1 corresponding to FIG. 23. The position of the coupling counter piece 24 corresponds to the position of the movable furniture part 2 which is located in the closed position SS. In addition, the locking device 17 is in the locking position VS as the line of action W of the ejection force storage member 5 is running through the rotary axis X. The triggering bracket 53 abuts with its front side the eccentric pin 50. The knee region of the triggering bracket 53, in turn, abuts the end region of the triggering element 55. The other end of this triggering element 55 abuts the coupling counter piece 24. The head region of the coupling piece 25 is indeed spread by the tip 47 of the coupling and decoupling element 27, as the head region of the coupling piece 25, however, is not located in the receiving region of the coupling counter piece 24, the coupling device 26 is still in a decoupling position EK.

Figure 25:
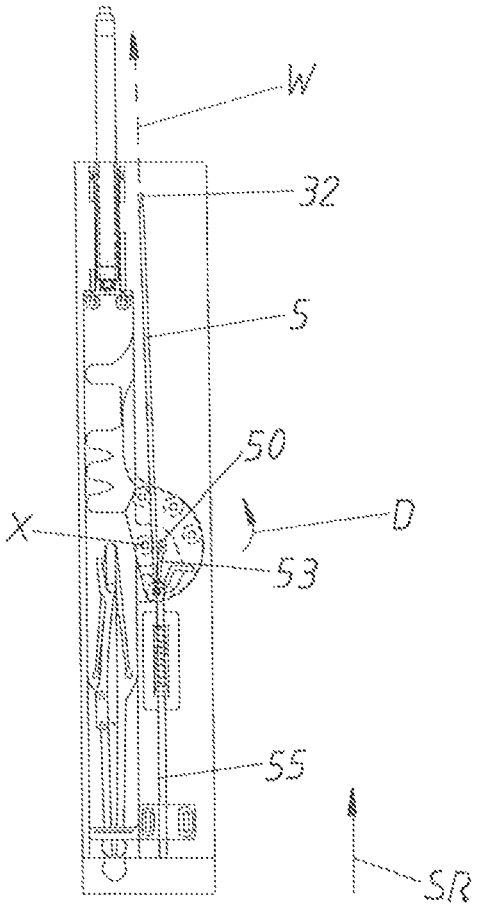

If now pressing in the closing direction SR onto the movable furniture part 2 starting from this closed position SS according to FIG. 24, the movable furniture part 2 arrives in the over-pressing position US according to FIG. 25. As the triggering element 55 abuts the coupling counter piece 24 and as the flexible triggering bracket 53, in turn, abuts the triggering element 55 by means of its knee region, the front side of the triggering bracket 53 is being pressed onto the eccentric pin 50, whereby the ejection element 4 is being rotated in the rotary direction D about the rotary axis X. As a consequence, the rotary axis X and the line of action W arrive in a relative unlocking state ES where the rotary axis X and the line of action W are distanced from each other. Thus, the locking device 17 is unlocked. (In the shown embodiment the ejection element force storage member base 29 is always moved for the unlocking. In principle, however, it would also be possible that, when over-pressing, the rotary axis X is shifted in such a way that the rotary axis X is distanced from the line of action W. Thereby, the line of action W would remain unchanged in relation to the carrier 3, the rotary axis X, however, would move relative to the carrier 3.)

Figure 26:
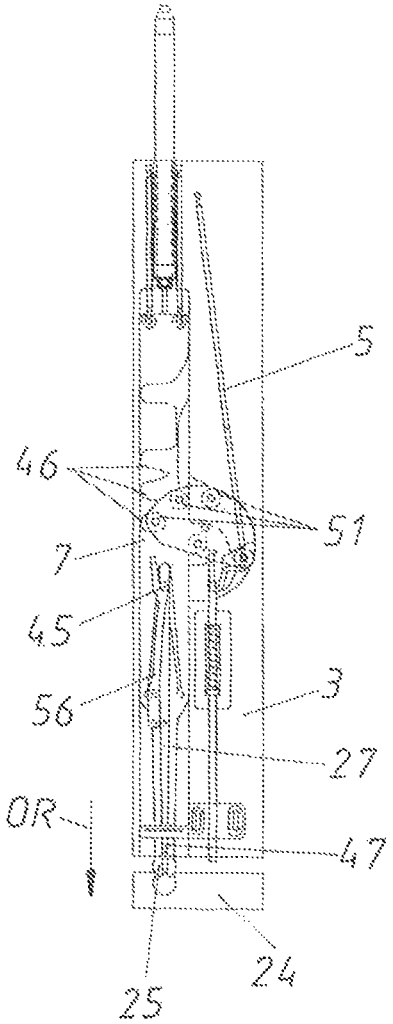

As soon as a user of the item of furniture 21 is no longer pressing onto the movable furniture part 2, the ejection force storage member 5 starts to further relax according to FIG. 26. This ejection force storage member 5 moves the ejection element 4 and rotates the ejection element 4 counterclockwise further in the rotary direction D. As a consequence, the first of the three ejection rollers 51 reaches contact with the first of the three ejection abutments 46, whereby the tensioning element 7 is being moved by the ejection element 4 in the opening direction OR. As the coupling piece 25 is integrally formed with the tensioning element 7, also the coupling counter piece 24 and the movable furniture part 2 (together with the coupling counter piece 24) is being moved in the opening direction OR by means of the head region of the coupling piece 25. Thereby, the movable furniture part 2 is in a—albeit still marginal opened—open position OS. The locking device 17 is in an unlocking state ES. The coupling device 26 is still in a decoupling position EK. According to FIG. 26, the tensioning element 7 has already been slightly moved in the opening direction OR relative to the carrier 3. However, as the coupling element tensioner 56 is attached to the carrier and as the abutment 45 abuts this coupling element tensioner 56, the coupling and decoupling element 27 forming the control device does not move together with the tensioning element 7 in the opening direction OR. As a consequence, the tip 47 of the coupling and decoupling device 27 is removed from the head region of the coupling piece 25. Thus, the head region of the coupling piece 25 is already less spread.

Figure 27:
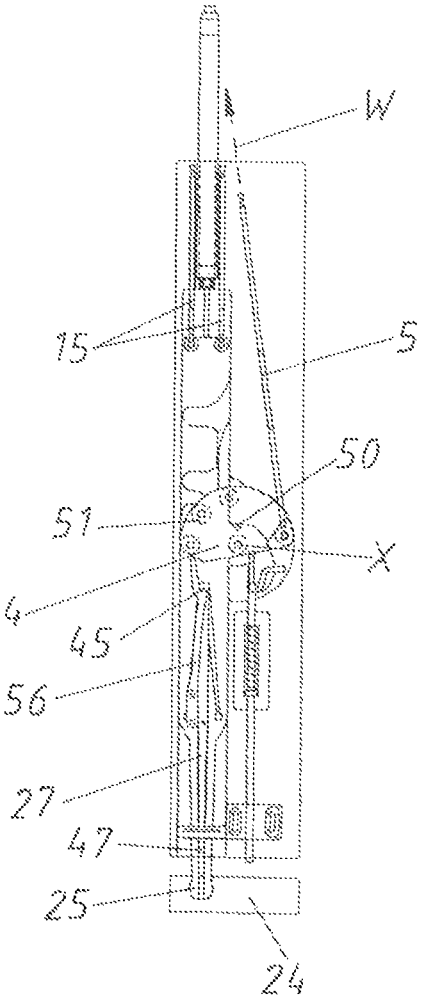

As according to FIG. 27 the tip 47 is still further moved back relative to the coupling piece 25, the head region of the coupling piece 25 is no longer spread and this head region can slide into the receiving region of the coupling counter piece 24 because of the bendable design of its two projections. As a consequence, however, only a loose connection between the coupling piece 25 and coupling counter piece 24 is reached. The coupling force storage member 40 is tensioned according to FIG. 27 by the movement of the coupling and decoupling element 27 along the guide track 28 relative to the tensioning element 7. According to FIG. 27 also the ejection element 4 has already rotated further, whereby a second ejection roller 41 reaches contact with a second ejection abutment 46.

Figure 28:
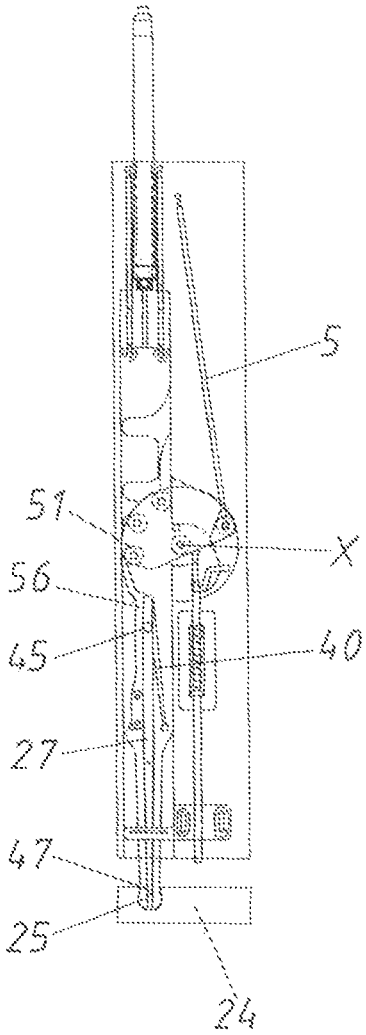

In the case of a further rotation of the ejection element 4 according to FIG. 28, an end of the elastic coupling element tensioner 56 reaches contact with the ejection element 4, whereby the coupling element tensioner 56 is slightly bent to the left. As a consequence, the abutment 45 of the coupling and decoupling element 27 is no longer held by the coupling element tensioner 45, whereby the coupling force storage member 40 can relax. Thereby, also the coupling and decoupling element 27 is again moved relative to the tensioning element 7 in the opening direction OR, whereby the tip 47 of the coupling and decoupling element 27 arrives in the head region of the coupling piece 25 and spreads this coupling piece 25. As a consequence, a safe positive-locking engagement and, thus, the coupling position K between the coupling piece 25 and the coupling counter piece 24 is reached. This coupling position K cannot be released without a movement of the coupling and decoupling device 27 relative to the coupling piece 25.

Figure 29:
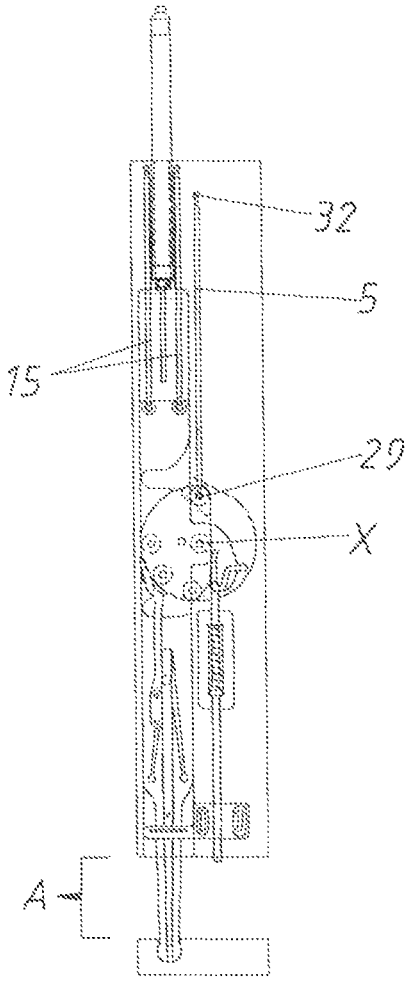

A half turn of the ejection element 4 is finished according to FIG. 29. Hence, the ejection force storage member 5 has completely relaxed and the ejection element 7 is again located in a neutral position. For this reason, the ejection path A of the ejection device 1 is finalized. The retrieving force storage members 15 have already relaxed about halfway. Starting from this FIG. 29 the movable furniture part 2 is now being pulled in the opening direction OR.

Figure 30:
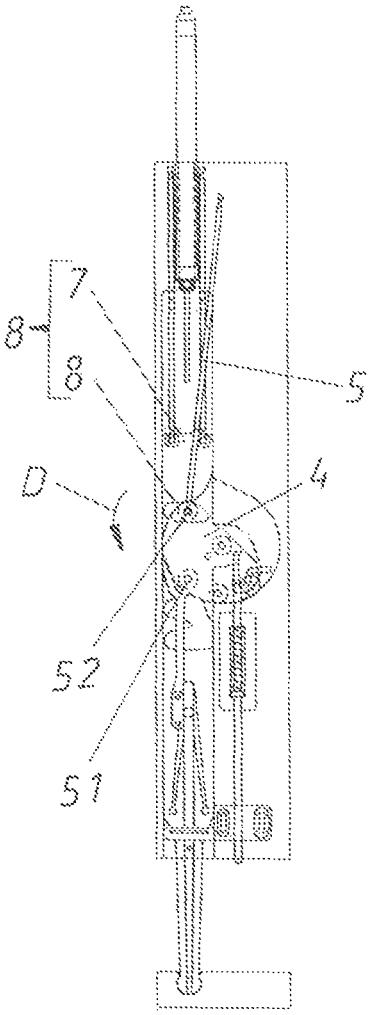

By this further pulling movement, which has already begun in FIG. 30, the tensioning element 7 is being moved further in the opening direction OR relative to the carrier 3. As a third ejection roller 51 is still in contact with the third ejection abutment 46, also the ejection element 4—when tensioning the ejection force storage member 5—is further rotated in the same direction D as when ejecting the movable furniture part 2. At the same time, also the tensioning roller 52 contacts the movement transmission element 8. The tensioning element 7 together with this movement transmission element 8 formed as an abutment are forming the tensioning device 6 for the ejection force storage member 5. This ejection force storage member 5 is already partly tensioned in FIG. 30.

Figure 31:
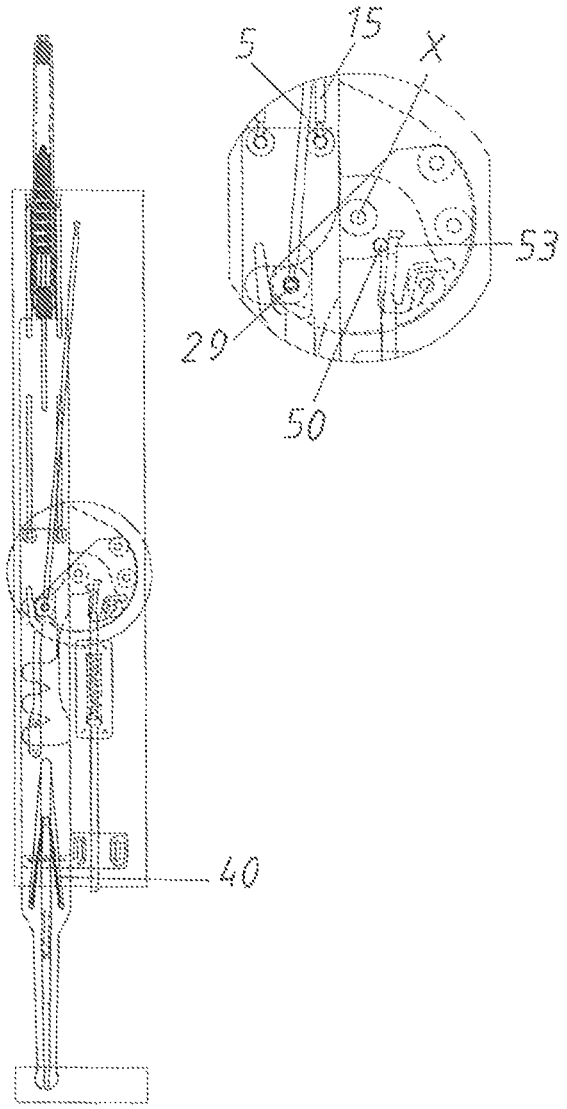

According to FIG. 31, the movable furniture part 2 has still been moved further in the opening direction OR and at the same time the ejection element 4 has been rotated further in the rotary direction D, whereby the eccentric pin 50 abuts a flank of the triggering bracket 53 and bends this triggering bracket 53 already slightly to the right because of its flexibility. This can be seen well in the detail shown top right.

Figure 32:
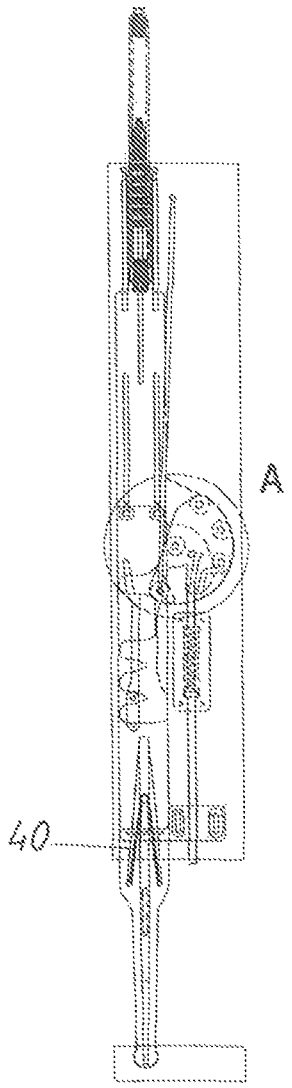

In FIG. 32, the movable furniture part 2 has still been moved further in the opening direction OR, whereby the ejection element 4 has rotated further. As a consequence, the eccentric pin 50 bends the triggering bracket 53 in a still more significant manner (see detail top right).

Figure 33:
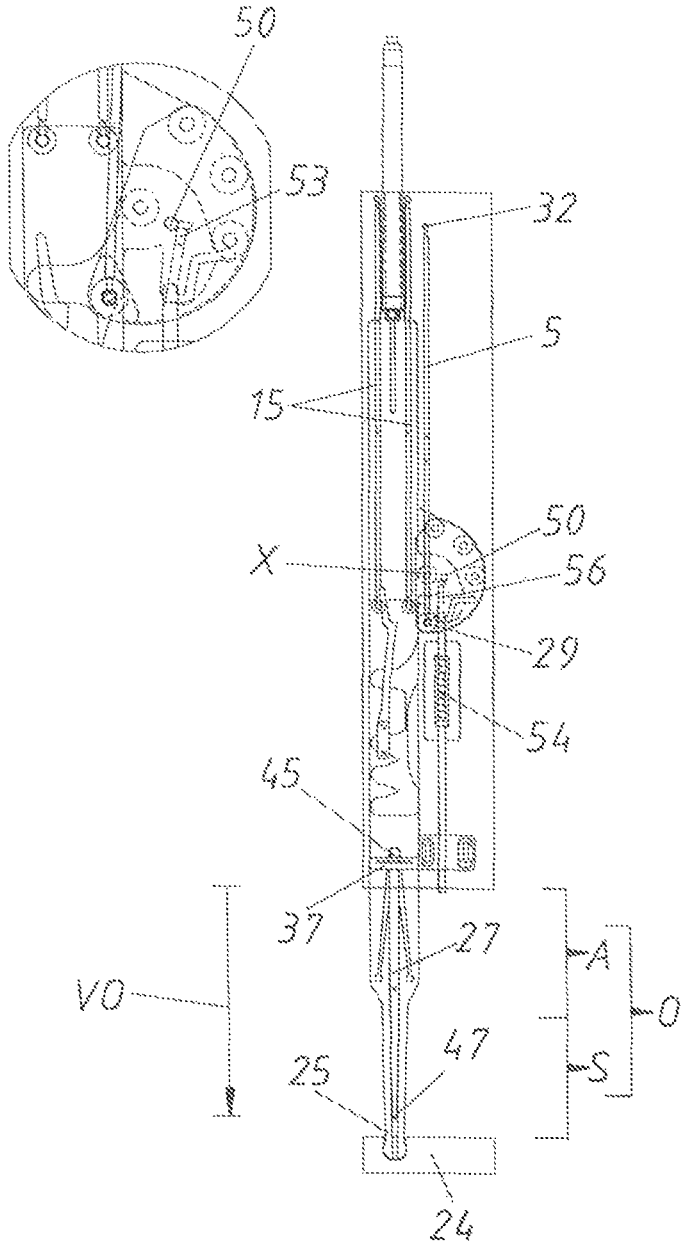
Figure 34:
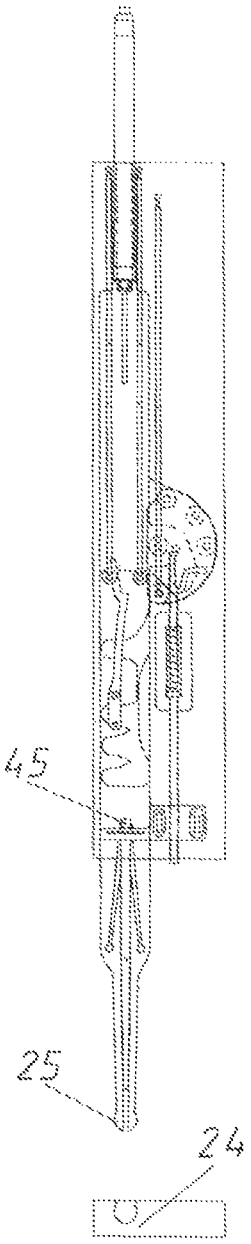

In the case of a further movement, the eccentric pin 50 finally passes the triggering bracket 53, whereby both components again arrive in their starting positions according to FIG. 33. The position of the triggering element 55 is again adapted by the triggering spring 54 in such a way that the triggering element 55 projects from the carrier by the gap size. According to FIG. 33 the tensioning path S is finalized. The tensioning path S together with the ejection path A results in the opening path O of the ejection device 1. During the movement of the ejection device 1 from FIG. 32 to FIG. 33 the abutment 45 of the coupling and decoupling element 27 reaches contact with the head portion 37. The predetermined opening path VO is reached. As a consequence, also this coupling and decoupling element 27 is moved relative to the tensioning element 7 (at the same time the coupling force storage member 40 is being loaded), whereby the tip 47 of the coupling and decoupling element 27 is removed from the head region of the coupling piece 25 and the projections of this head region are no longer spread. Thus, the decoupling position EK of the coupling device 26 is reached. However, there is still a loose connection between the head region of the coupling piece 25 and the receiving region of the coupling counter piece 26.

If now further pulling on the movable furniture part 2 starting from this position according to FIG. 33, the coupling counter piece 24 can be released from the coupling piece 25 by bending the projections of the head region to each other and also the loose connection is repealed.

Figure 35:
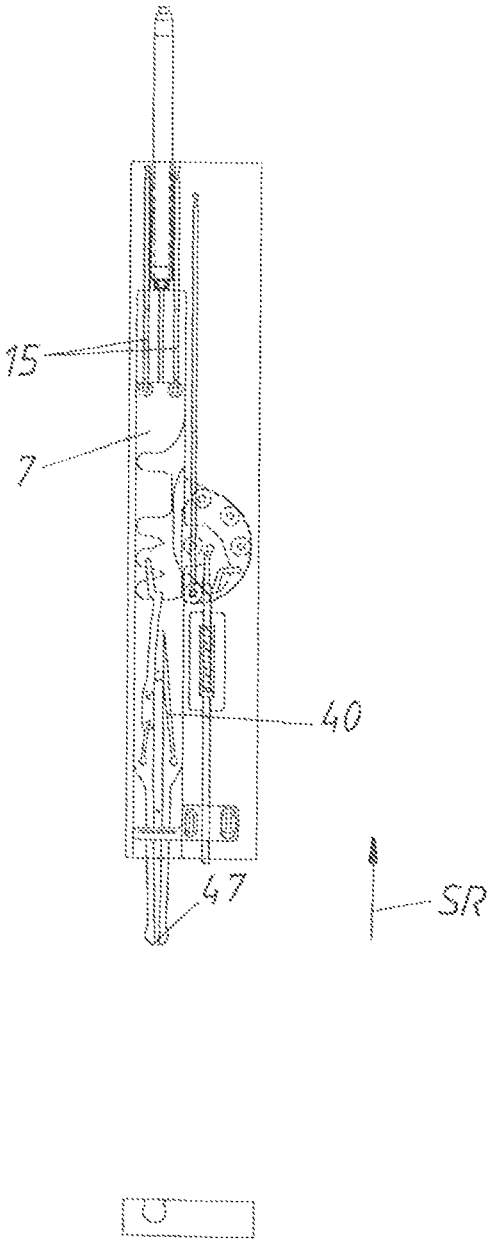

Starting from reaching this decoupling position EK, the retrieving force storage member 15 can also again relax and initially moves the tensioning element 7 in the closing direction SR until reaching the position according to FIG. 35. Simultaneous with this movement or starting from the point in time, when the abutment 45 no longer abuts the head portion 37, the coupling force storage member 40 can relax. AS a consequence, the tip 47 of the coupling and decoupling element 27 is moved into the head region of the coupling piece 25, whereby the head region is again being spread.

Figure 36:
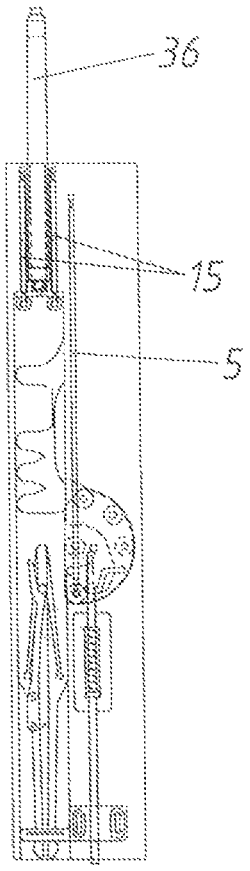

In FIG. 36, the retrieving force storage member 15 has fully relaxed. This retrieving movement is damped by the piston of the damping device 36. Thereby, the retrieved position R of the retrieving device 13 or the retrieving force storage member 15 is reached. However, the movable furniture part 2—represented by the coupling counter piece 24—is still located in an open position OS.

Figure 37:
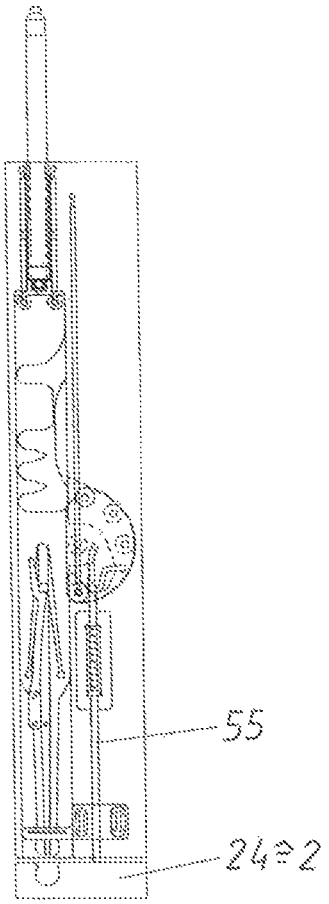
Figure 37:
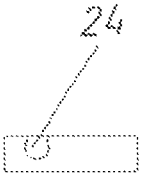

When finally, according to FIG. 37, even the movable furniture part 2 is moved in the closing direction SR, the movable furniture part 2 arrives in the closed position SS. In this closed position SS, the coupling counter piece 24 again abuts the triggering element 55. The locking device 17 is in the locking position VS. The coupling device 26 is in the decoupling position EK. FIG. 37 corresponds again with the starting position according to FIG. 24.

Lastly, it shall be pointed out that in the embodiments, the same functional components are referred to with the same reference signs. Therefore, the advantages and mentioned possibilities to the embodiments each analogously apply to the other embodiments.

The invention claimed is:

1. An ejection device for a movable furniture part, comprising:

a rotatable ejection element configured to apply an ejection force to the movable furniture part to eject the movable furniture part from a closed position into an open position, wherein, when the movable furniture part is ejected, the ejection element is configured to be rotated in a rotary direction, an ejection force storage member configured to force-actuate the ejection element in an opening direction of the movable furniture part, and a tensioning device configured to tension the ejection force storage member via the ejection element, wherein the ejection element and the ejection force storage member are further configured such that, when the ejection force storage member is tensioned, the ejection element is rotatable in the same rotary direction as when the movable furniture part is ejected.

2. The ejection device according to claim 1, wherein the ejection element is configured such that, when ejecting the movable furniture part and when tensioning the ejection force storage member, the ejection element travels a rotary path in the form of a full revolution in total, wherein the ejection element substantially travels one half of a full revolution when ejecting the movable furniture part, and substantially travels the other half of the rotary path when subsequently tensioning the ejection force storage member.

3. The ejection device according to claim 1, further comprising a carrier.

4. The ejection device according to claim 3, wherein the ejection force storage member engages the carrier and engages the ejection element.

5. The ejection device according to claim 3, wherein the carrier is formed as a housing.

6. The ejection device according to claim 1, wherein the tensioning device is configured to be coupled to the movable furniture part by a coupling device.

7. The ejection device according to claim 1, wherein the ejection force storage member is configured to be tensioned by the tensioning device by pulling the movable furniture part in the opening direction.

8. The ejection device according to claim 1, wherein the movable furniture part is configured to be indirectly moved in an open direction by the ejection element via a tensioning element of the tensioning device.

9. The ejection device according to claim 1, further comprising a retrieving force storage member configured to move the tensioning device into a retrieved position.

10. The ejection device according to claim 1, further comprising a locking device configured to lock the ejection element in a locking position, the locking device configured to be unlocked by over-pressing the movable furniture part into an over-pressing position located behind the closed position with respect to a closing direction.

11. The ejection device according to claim 1, wherein the ejection element is configured to be rotated about a rotary axis, the rotary axis being oriented transversely to an ejection path of the ejection device.

12. The ejection device according to claim 11, wherein the rotary axis is oriented prependicular to an ejection path of the ejection device.

13. The ejection device according to claim 1, wherein the ejection element is configured to be rotated about a rotary axis perpendicular to a plane through which the movable furniture part travels.

14. An item of furniture comprising: a furniture carcass, a movable furniture part, and the ejection device according to claim 1 for ejecting the movable furniture part.

* * * * *